United States Patent [19]

Dong

[11] Patent Number: 4,836,533

[45] Date of Patent: Jun. 6, 1989

[54] VARIABLE TENSION LOADED STRIKING APPARATUS

[76] Inventor: Jimmy Dong, P.O. Box 452, Tahoe Vista, Calif. 95732

[21] Appl. No.: 850,094

[22] Filed: Apr. 10, 1986

[51] Int. Cl.[4] ..... A63B 69/00

[52] U.S. Cl. ..... 272/76

[58] Field of Search ..... 272/65, 76–78, 272/93, 130, 72, 901; 273/55 R, 53, 392, 390, 391

[56] References Cited

U.S. PATENT DOCUMENTS

| | | | |
|---|---|---|---|
| 1,328,344 | 1/1920 | Smolens | 273/392 |
| 3,281,148 | 10/1966 | Cummins | 272/78 |
| 3,427,021 | 2/1969 | Donato | 272/76 |
| 3,638,941 | 2/1972 | Kulkens | 272/130 |
| 4,309,029 | 1/1982 | Tomko | 272/76 |
| 4,491,316 | 1/1985 | Prince | 272/78 |
| 4,635,929 | 1/1987 | Shustack | 272/77 |

FOREIGN PATENT DOCUMENTS

| | | | |
|---|---|---|---|
| 2528414 | 5/1976 | Fed. Rep. of Germany | 273/53 |

*Primary Examiner*—Richard J. Apley
*Assistant Examiner*—S. R. Crow
*Attorney, Agent, or Firm*—Mark C. Jacobs

[57] ABSTRACT

A variable tension loaded striking apparatus comprising a base having a pair of spaced upstanding ears between which are disposed a holder portion, the holder portion also being secured at one end of an adjustable air or hydraulic compression device, which at its opposite end is connected to the base of the apparatus. Removeably disposed within the holster portion is a striking board which is a plank or similar material adapted to serve as a blow receiving surface.

3 Claims, 3 Drawing Sheets

VARIABLE TENSION LOADED STRIKING APPARATUS

BACKGROUND OF THE INVENTION

1. Field of the Invention

The invention relates to a striking device for use in training in martial arts, such as boxing, karate, and Gung-Fu.

2. Description of the Prior Art

U.S. Pat. No. 4,309,029 relates to a striking device for martial artist composed of a flat base, two arc supports ending with two target areas and a vertical back brace for additional support. Between the arc supports are three spacers to provide variable tension adjustments.

OBJECTS

The present invention is so designed that, by adjusting the pressure of the variable hydraulic/air compression device, any martial artists can improve their angle, balance, and penetration targeting various heights of the striking surface, at the same time reducing recoil shock to the limbs.

Figure 1:
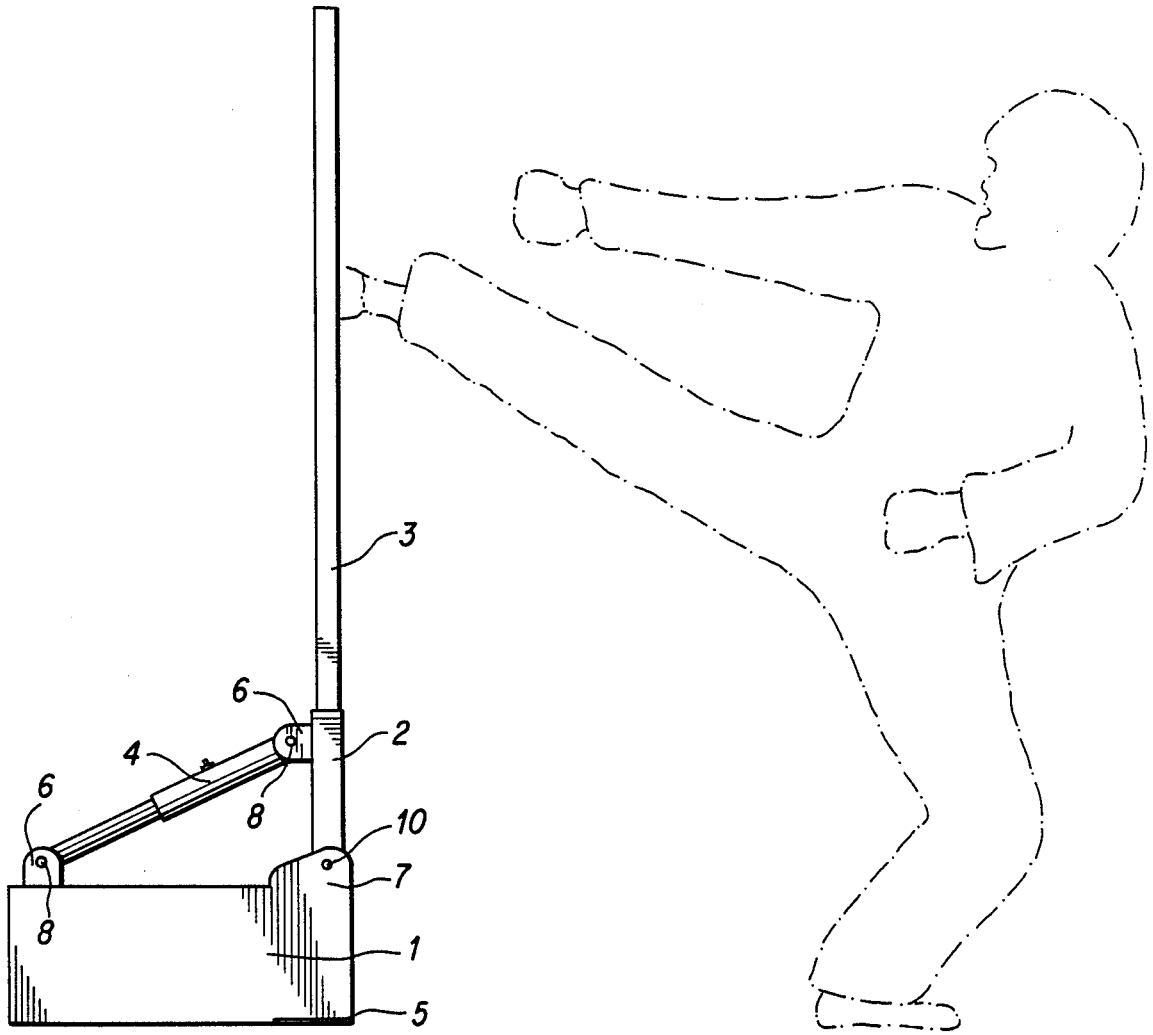
FIG. 1 is a sideview of the variable tension loaded striking apparatus with a martial artist shown in phantom lines kicking the apparatus.
Figure 2:
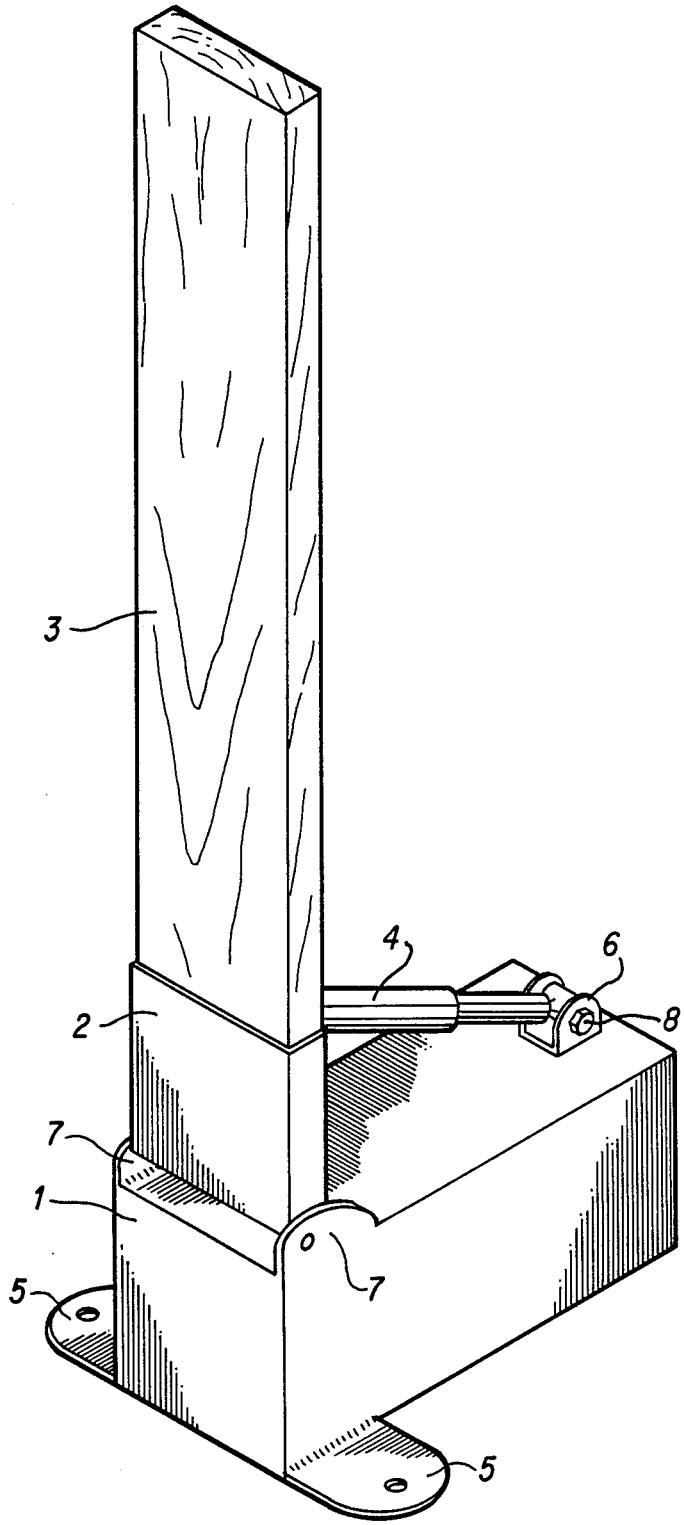
FIG. 2 is an oblique perspective view of a variable tension loaded striking apparatus in accordance with this invention.

Holder 2 is sized along the front and rear plates to be of slightly less extension than the length of shaft 10. the extension of holster 2 is also slightly less than the space between the two ears 7. Shaft 10's diameter is sized to fit within bores 7'.

The rear surface has a second U-shaped bracket 66, to distinguish it from first U shaped bracket 6, extending toward the rear of the base.

Figure 4:
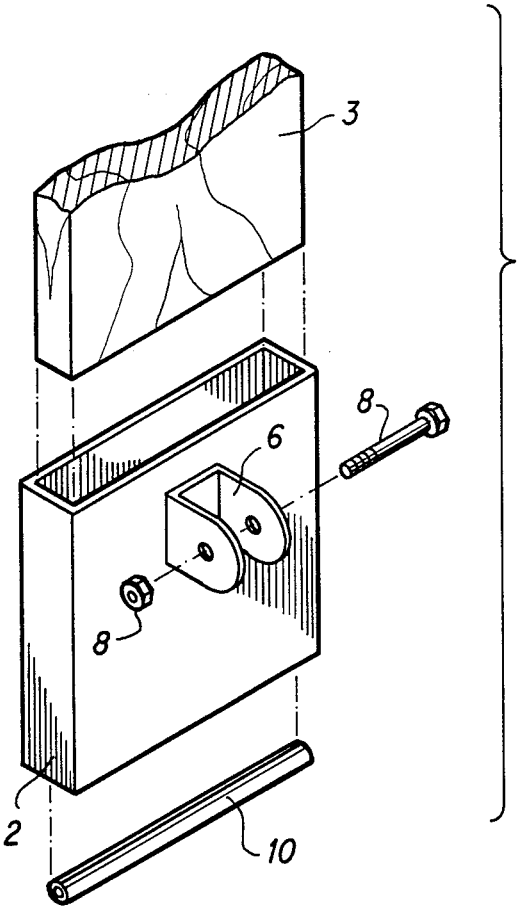
FIG. 4 is a perspective view of the board holster.
Figure 5:
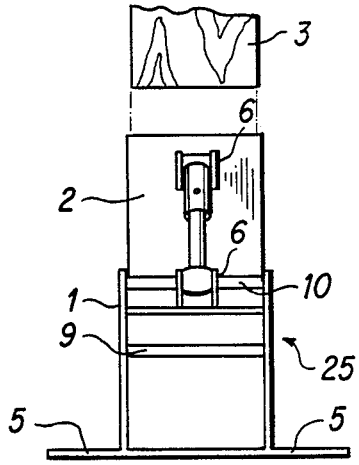
FIG. 5 is a back view of the present invention.
Figure 3:
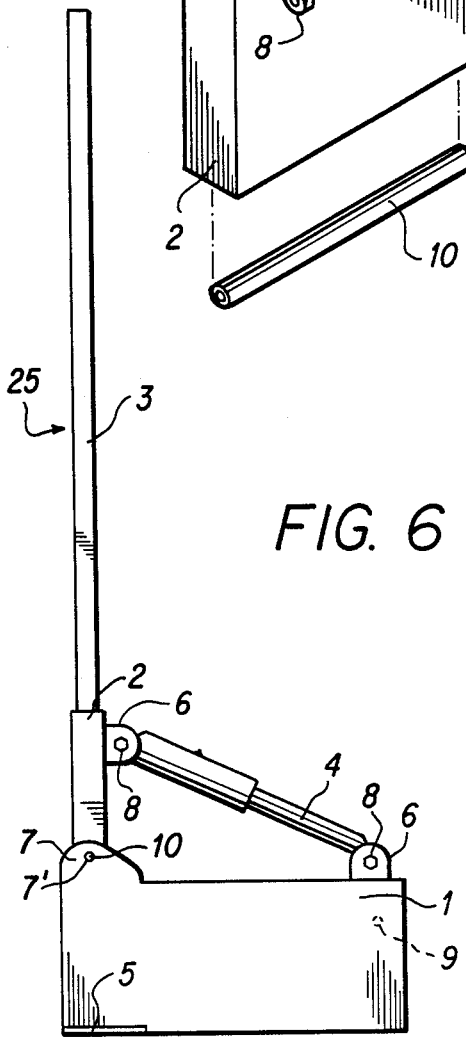
FIG. 3 is a sideview of the present invention.
Figure 6:
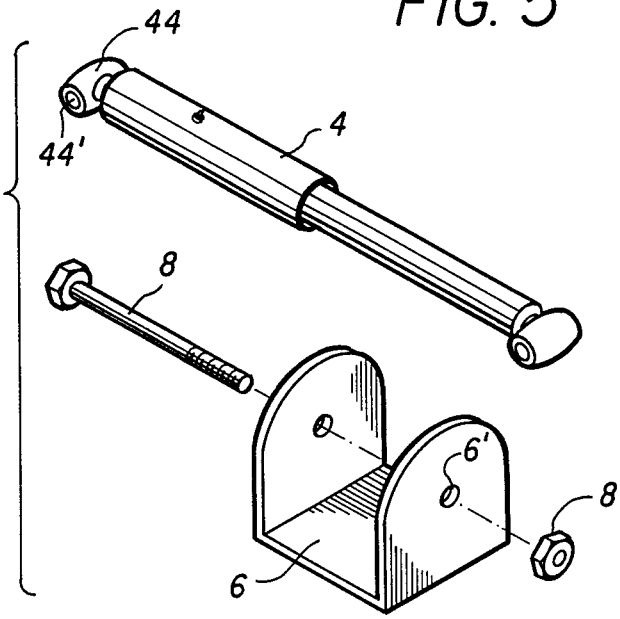
FIG. 6 is a perspective view of the compression device and U-bracket.

An hydraulic/or compression device, such as shock absorber 4 having hollow cylindrical mount means 44 at the opposite ends thereof, is secured between each U shaped bracket 66 and 6, per FIGS. 4 and 6, by vertical pins 8 extending through opening 44' for the mount to bracket 66 and through opening 44'' for the mount to bracket 6.

Compression device 4 is at rest when holster 2 is in a generally upright position and is tensed when holster 2 is pivoted rearwardly on shaft 10.

An optional handle 9 is disposed as by the welding of a rod between the two side walls of base 1. For added strength it can be disposed within a pair of aligned bores in the sidewalls before the welding operation. Thus handle can be used for carrying device 25 and is located toward the rear of the base.

Shown in FIG. 4 is a wooden striking member, such as a conventional piece of 2''×10'' wood of a non-critical length. The opening within the holster 2 is sized to frictionally receive strike member 3, and to retain same during the compression of compression device 4. The compression of the compression device is adjusted by means known to the art.

SUMMARY OF THE INVENTION

A variable tension loaded striking device comprising a base having a pivoting holder portion, which portion is connected to an angularly disposed compression device, and being open at the top thereof. The compression device is connected at its other end to the base. Disposed within the holder portion is a wood plank or the like, frictionally or otherwise retained therein.

DETAILED DESCRIPTION

As seen in the figures, the device 25 of this invention is a variable tension loaded striking apparatus for use by martial artists. Device 25 includes a base 1, having a pair of feet 5 welded or otherwise attached to said base, extending outwardly from the forward end of said base. Base 1 is generally rectangular in configuration with the sides being longer than the front or back thereof. The other two walls thereof being the upper and lower walls.

At the top of the base, extending rearwardly and upwardly from the forward end of the base are a pair of spaced ears 9. The ears may be welded to the sides of said base 1. A pair of bores 7', one in each ear are sized and are aligned to receive shaft 10, to be described. Base 1 may be open or closed at the front and is open at the rear thereof.

A U-shaped bracket shown best in FIG. 6 is mounted on the upper surface of said base at or near the rear end thereof. Each upstanding member of the U-shaped bracket has a throughbore 6'.

Holster 2, which is open at the top elongated rectangular portion, may be optionally closed off entirely at the bottom by a plate not seen, or it may be closed off in part by shaft 10 which may be welded to the holster 10 along the underside edges thereof. If a bottom plate is present, shaft 10 would be secured to the bottom plate of the holster 10.

OPERATION

In FIG. 1 the practitioner is shown about to impact the striking surface of the variable tension loaded striking apparatus. During the event of this impact, the striking surface is pushed back, thereby encountering the resistance provided by the hydraulic/air compression device, and providing the simulation of a deep penetrating blow. The compression device, which can be adjusted to various degrees of resistance according to the needs of the user, then automatically returns in a controlled manner to it's original position, ready for continued use. For stability, the base has welded legs with holes to accommodate screws or bolts for attachment to the floor.

I claim:

1. A martial arts tension loaded striking apparatus comprising:

(a) a generally rectangular base optionally closed off at the front thereof, and having an upper and lower wall, and a pair of spaced side walls;

(b) a pair of spaced ears mounted at the forward end of said base at the top of each side wall, each ear having a bore therethrough which pair of bores are aligned;

(c) a generally rectangular holster for receiving a striking surface having a front and rear wall, and being open at the top and having a shaft secured along the bottom thereof, and extending outwardly beyond the sides of said holster, said shaft being positionable within the bores of said ears to pivotally mount said holster in a generally upright position, (d) a first U bracket mounted at the rear of said base on the upper wall thereof, (e) a second U bracket mounted on the rear wall of said holster, and (f) an hydraulic/air compression device secured to each of said U brackets, whereby upon application of an impact to said striking surface disposed within said holster, the holster pivots rearwardly said pivoting action being resisted by the compression device.

2. The apparatus of claim 1 including a pair of legs extending from said base on opposite sides thereof.

3. The apparatus of claim 1 wherein the holster is configured rectangularly, and is sized to receive a 2″×10″ board.

* * * * *